US005860519A

United States Patent [19]

Meyer et al.

[11] Patent Number: 5,860,519

[45] Date of Patent: Jan. 19, 1999

[54] SPORTS EQUIPMENT CARRIER HAVING HIGH STRENGTH TO WEIGHT RATIO RIGID OUTER SECTION

[75] Inventors: Steve D. Meyer, Baldwin; Scott J. Herman, Menomonie, both of Wis.

[73] Assignee: Stone Legacy Corporation, Menomonie, Wis.

[21] Appl. No.: 630,857

[22] Filed: Mar. 27, 1996

[51] Int. Cl.[6] ..... A63B 55/00; A63B 55/08; B65D 1/46; B65D 43/00

[52] U.S. Cl. ..... 206/315.3; 206/315.1; 206/315.4; 206/315.5; 206/315.6; 206/315.7; 206/315.8

[58] Field of Search ..... 206/315.3–315.8, 206/315.1, 315.2

[56] References Cited

U.S. PATENT DOCUMENTS

| | | | |
|---|---|---|---|
| 1,128,921 | 2/1915 | Wadsworth | 206/315.8 |
| 1,176,031 | 3/1916 | Cady . | |
| 1,591,914 | 7/1926 | Farish . | |
| 1,918,447 | 7/1933 | Blatz | 206/315.6 X |
| 1,924,182 | 8/1933 | Fritz | 206/315.7 X |
| 2,128,546 | 8/1938 | Venmore | 150/160 X |
| 2,282,842 | 5/1942 | Abell . | |
| 2,661,174 | 12/1953 | Sands . | |
| 3,286,902 | 11/1966 | Hunter et al. | 220/672 X |
| 3,664,399 | 5/1972 | Neff | 150/160 |
| 3,674,072 | 7/1972 | Shuto | 206/315.5 X |
| 3,746,204 | 7/1973 | Nagai | 220/469 X |
| 3,985,229 | 10/1976 | Maki | 206/315.6 |
| 4,091,977 | 5/1978 | Luttbeg | 206/315.4 |
| 4,142,563 | 3/1979 | Ackerfeldt | 206/315.5 |
| 4,350,194 | 9/1982 | Brown | 206/315.5 |
| 4,509,643 | 4/1985 | Rhee | 206/315.6 |
| 4,522,299 | 6/1985 | Clark et al. | 206/315.3 |
| 4,538,439 | 9/1985 | Frei | 220/672 X |
| 4,643,302 | 2/1987 | Baumgardner | 206/315.3 X |
| 4,767,001 | 8/1988 | Kim | 206/315.3 |
| 4,778,136 | 10/1988 | Reimers | 206/315.7 X |
| 4,779,725 | 10/1988 | Gerber | 206/315.3 |
| 4,905,827 | 3/1990 | Kim | 206/315.6 X |
| 4,953,773 | 9/1990 | Wirth | 206/315.1 X |
| 5,002,185 | 3/1991 | Schurman | 206/315.3 X |
| 5,005,624 | 4/1991 | Sung | 206/315.2 X |
| 5,062,528 | 11/1991 | Whitaker, Jr. | 206/315.3 |
| 5,112,068 | 5/1992 | Liao et al. | 206/315.3 |
| 5,188,243 | 2/1993 | Ruiz | 206/315.3 X |
| 5,244,086 | 9/1993 | Welch | 206/315.4 |
| 5,255,781 | 10/1993 | Dulyea, Sr. | 206/315.6 |
| 5,311,987 | 5/1994 | Shin | 206/315.3 X |
| 5,341,928 | 8/1994 | Jones et al. | 206/315.5 |
| 5,437,320 | 8/1995 | Sung | 150/160 |
| 5,465,840 | 11/1995 | Joh | 206/315.3 X |
| 5,540,431 | 7/1996 | Crozier | 206/315.3 X |

FOREIGN PATENT DOCUMENTS

| | | | |
|---|---|---|---|
| 2130102 | 5/1984 | United Kingdom | 206/315.6 |

*Primary Examiner*—Sue A. Weaver
*Attorney, Agent, or Firm*—Nilles & Nilles S.C.

[57] ABSTRACT

A sports equipment carrier for carrying golf clubs and the like having a tubular substantially rigid body comprised of a sidewall that is ribbed or honeycombed along its longitudinal length for producing a high strength-to-weight sports equipment carrier body capable of being used as a golf bag and which is convertible to a shipping container when a removable substantially rigid lid is attached. In one embodiment, the carrier has a plurality of pairs of axially spaced apart radially extending transverse and annular ribs distributed along the longitudinal length of the body. In another embodiment, the ribbed sidewall comprises a single spiraling rib. In a still further embodiment, the sidewall is comprised of radially extending honeycomb cells forming a honeycombed portion that extends about a periphery of the carrier body and which is distributed the entire length of the sidewall. The ribs or honeycombs can be integral with the sidewall with the sidewall and ribs or honeycombs constructed of high density polyethylene, a polyolefin, plastic material. The exterior of the carrier body can be covered with fabric that can be colored to provide an aesthetically pleasing exterior that also protects the carrier body. The carrier can also have storage pouches, a carrying strap, and wheels, all of which are removable to facilitate conversion of the carrier to a shipping container.

24 Claims, 6 Drawing Sheets

SPORTS EQUIPMENT CARRIER HAVING HIGH STRENGTH TO WEIGHT RATIO RIGID OUTER SECTION

FIELD OF THE INVENTION

The present invention is directed to sports equipment carriers, more particularly to a sports equipment carrier comprising a rigid body of a high strength-to-weight ratio ribbed or honeycombed construction for added protection of the sports equipment therein and ease of handling during shipment and transit.

BACKGROUND OF THE INVENTION

Conventional sports equipment carriers are often bulky and are made of flexible fabric that generally offers little protection for the usually expensive sports equipment carried therein. Baggage handlers at airports, train stations, bus depots, and hotels frequently show little respect to travelers' luggage and sports equipment bags as they rush to load and unload baggage of all shapes and sizes. Expensive sports equipment within the baggage is often damaged by such rough handling.

Further, rain, sleet, snow, oil, grease and other liquids may seep into conventional flexible fabric sports equipment bags and damage the expensive equipment within. If the sports equipment is accidently stored when such moisture is present, further damage to the equipment may result.

Past proposals to provide a more rigid sports equipment bag for use in transit have met with limited success. For example, although the rigid polyethylene golf bag shown in U.S. Pat. No. 4,522,299, provides somewhat adequate protection for the golf clubs during transit or shipment, it fails in many other respects. However, its handle, wheels, legs, struts, slide, cable, and a pulley remain attached to the exterior of the bag during travel, making the bag bulky and difficult to carry. Furthermore, these additional components, the golf bag's thermoplastic shell, and the golf bag's expanded interior, which is needed to carry additional accessories such as golf balls, golf tees, gloves and the like, add additional weight to the golf bag. Therefore, it is an object of the invention to provide a rigid sports equipment carrier made with a high strength to weight ratio structure which is lightweight and which provides significantly increased protection to the equipment therein during shipment and transit.

Similarly, U.S. Pat. No. 4,767,001 discloses a golf bag having a generally cylindrical lower portion and a generally cylindrical rigid upper portion. The rigid upper portion has first and second halves vertically hinged along a side and a latch on a side opposite the vertical hinge. The rigid bag disclosed in U.S. Pat. No. 4,767,001 may also have a rigid body. However, the golf bag disclosed does not have a high strength to weight ratio structure nor does it have any detachable pouches. Thus, it is another object of the present invention to provide a sports equipment carrier which is fitted with detachable pouches to provide a less bulky carrier for greater ease in handling during shipment and transit.

It is yet another object of the invention to provide a liquid-resistant sports equipment carrier to prevent damage of the sports equipment stored therein.

SUMMARY OF THE INVENTION

A sports equipment carrier having a generally tubular body constructed of a light weight, high strength, substantially rigid outer section that is composed of a sidewall of ribbed or honeycombed material for producing a sports equipment carrier having a body that is light weight and crush resistant making the carrier well suited for withstanding the harsh abuse typically encountered during shipment and use. To facilitate shipment, external components, such as its wheels, handles and the like can be removed to prevent damage and loss. To protect equipment received in the carrier, the carrier further includes a substantially rigid removable cover or lid which encloses the equipment stored in the carrier and securely engages the body of the carrier to protect the equipment, particularly during shipment. When the carrier is used as a golf bag, the lid is constructed and arranged to fit over the club heads of the clubs received in the bag while also being securely attached to the body of the bag.

In overcoming the disadvantages of the prior art and meeting the general objectives, the sports equipment carrier of the present invention comprises: a generally tubular rigid body including a bottom end, a top end, an inner section having a cavity for receiving an article of sports equipment, and an outer section having a wall including a structure that has a high strength to weight ratio, a base at the bottom end of the body, a lid removably attached at the top end of the body, a carrying strap removably attached to the body of the equipment carrier, and pouches which are removably attached to the body. Further, legs may be collapsibly connected to the body to hold the body in a nearly upright position. Wheels with axles may also be removably attached to provide further ease in transportation of the sports equipment carrier.

More particularly, the invention provides a golf equipment carrier or golf bag with an outer section having a wall including a spiraling rib, a plurality of annular ribs or honeycombs to provide added protection for golf clubs contained therein by increasing the strength of the bag by increasing its crush resistance. The golf bag also includes a lid having two elements, a latch, and a lock to provide further security for the clubs during transit or shipment. The body has an inner section having a cavity and containing an inner wall. The inner wall may also have branches to further compartmentalize the inner section and provide protection for the clubs. The golf bag of the present invention further comprises flexible walled pouches for carrying additional golf accessories and miscellaneous items. The pouches are removably attached to the body of the bag so that the pouches may be removed during transit or shipment. The golf bag has a removably attached carrying strap which can also be removed from the body during transit. The carrying strap has clips which may be attached to the pouches to help in handling the pouches during transit.

Other objects, features and advantages of the invention will become more apparent to those skilled in the art from the following detailed description and the accompanying drawings. It should be understood, however, that the detailed description and specific examples, while indicating preferred embodiments of the present invention are given by way of illustration and not by limitation. Many changes and modifications can be made within the scope of the present invention without departing from the spirit thereof, and the invention includes all such changes and modifications.

BRIEF DESCRIPTION OF THE DRAWINGS

Preferred exemplary embodiments of the invention are illustrated in the accompanying drawings in which like reference numerals represent like parts throughout.

DETAILED DESCRIPTION OF THE INVENTION

Figure 1:
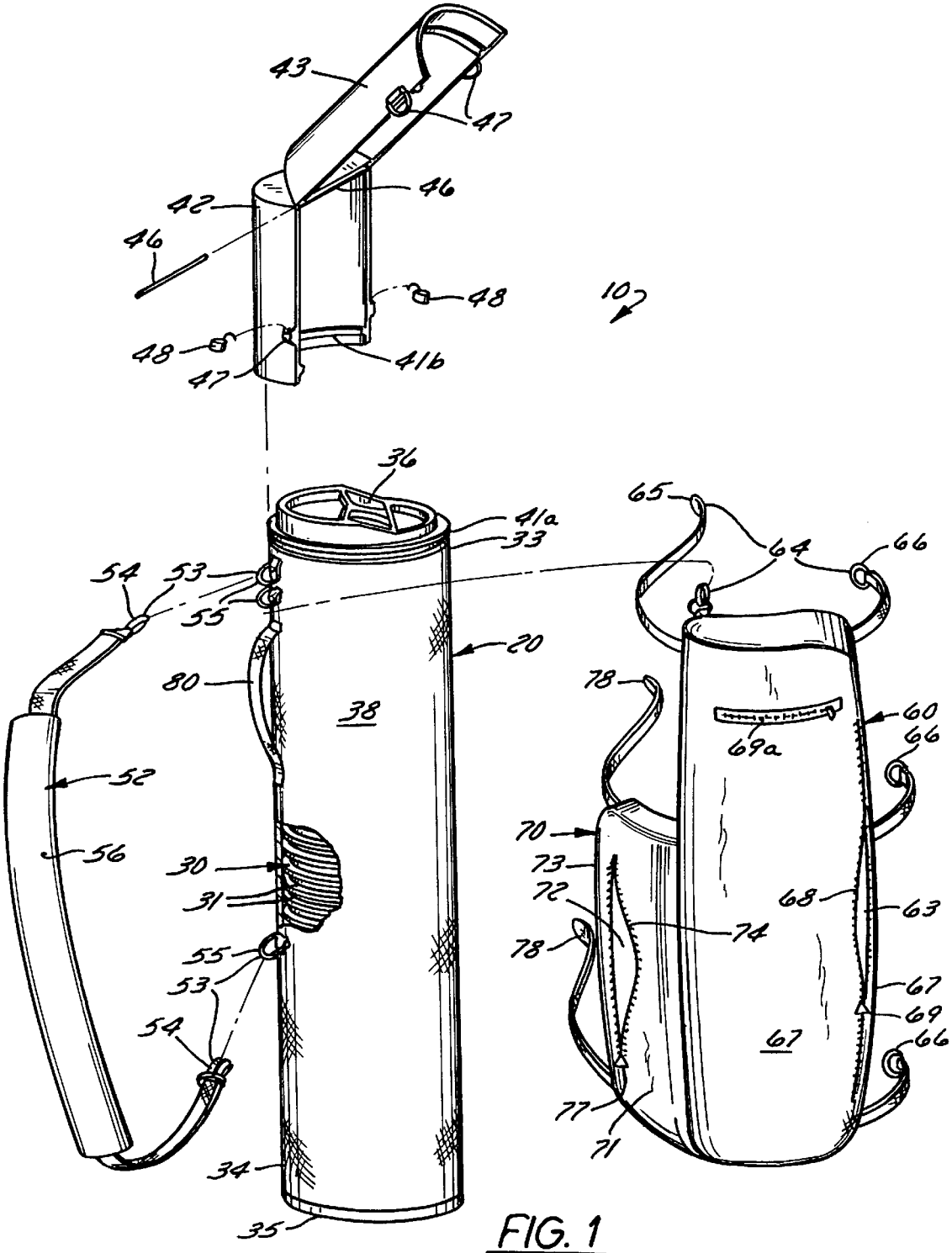
FIG. 1 is a partially exploded perspective view of a sports equipment carrier in accordance with the preferred embodiment of the present invention, with a portion of the body cover broken away to expose its high strength-to-weight ratio ribbed structure.

Referring generally to FIGS. 1–10, the sports equipment carrier 10 of the present invention comprises a generally tubular rigid body 20 that is of ribbed or honeycombed construction for producing a carrier 10 of this invention that is light weight and strong. As is shown more clearly in FIG. 9, the body 20 has an outer section 23, that includes a wall 26 where the ribs 31 or honeycombs or honeycomb cells 32 are located, and an inner section 24, that includes a void or cavity 27 for receiving sports equipment therein. The wall 26 has an inner portion 28 and an outer portion 29 with the inner portion 28 of the wall 26 dividing the outer section 23 of the body 20 from the inner section 24.

Although the invention relates to sports equipment carriers in general, this description will specifically address golf equipment carriers. In the preferred embodiment the generally tubular body is generally cylindrical, however it may be generally square, oval, or any other conceivable geometric shape. The outer section 23 has a wall 26, and the inner section 24 has a cavity 27 for receiving sports equipment. The wall 26 has an inner portion 28 and an outer portion 29. The inner portion 28 divides the outer section 23 from the inner section 24.

Figure 6:
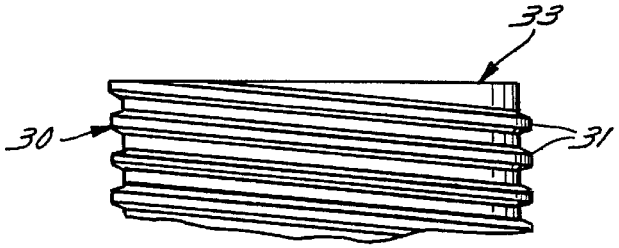
FIG. 6 is an enlarged cut-away elevational view of another embodiment of the sports equipment carrier.
Figure 7:
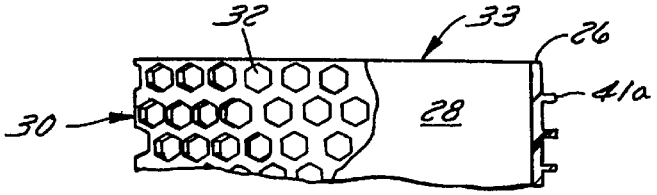
FIG. 7 is an enlarged cut-away elevational view of yet another embodiment of the sports equipment carrier.
Figure 8:
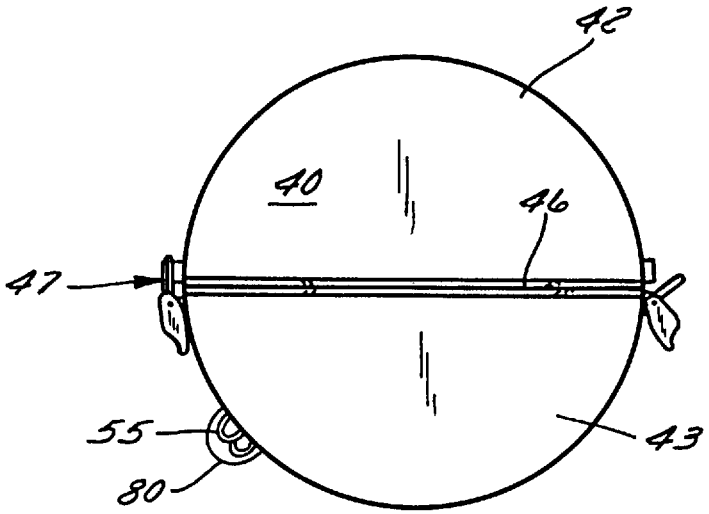
FIG. 8 is a top plan view of the sports equipment carrier as shown in FIG. 1.
Figure 10:
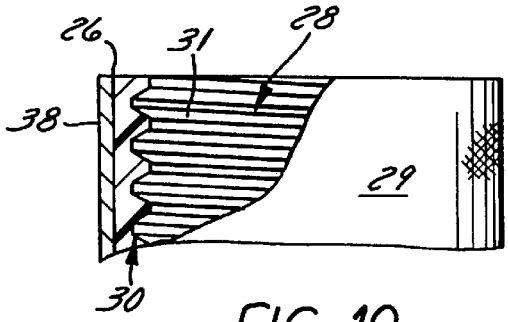
FIG. 10 is an enlarged cut-away elevational view of still another embodiment of the sports equipment carrier.

The wall 26 is made of a lightweight, high strength material having a high strength-to-weight ratio structure 30 sufficient to withstand a high degree of crushing force and impact shock that may occur during transit or shipment. The lightweight, high strength material is preferably high density polyethylene (HDPE). FIGS. 1, 6, and 10 show the high strength to weight ratio structure 30 may include a single spiraling rib (FIG. 6) or plurality of annular ribs 31 which are laid out generally horizontally (transverse) along the longitudinal length of the body 20 and are integral with the wall 26. Preferably, each rib 31 is integral with the outer portion 29 of the wall 26. However, embodiments may have the rib section 31 integral with the inner portion 28 of the wall 26 or located between the inner portion 28 and the outer portion 29. In another embodiment, the structure 30 may include a group of honeycombs 32 between the inner portion 28 and the outer portion 29 of the wall 26 as shown in FIG. 7.

In the preferred embodiment shown in FIG. 1, the ribbed wall structure 30 has a plurality of equally spaced annular ribs about ¼" apart along the entire length of the generally cylindrical tubular body 20. Each rib 31 is about 7/10" wide and about ½" high. Between each rib 31, the wall 26 has a thickness of about 1/10". The inner diameter of the generally cylindrical body 20 is about 7 ¾", while the outer diameter to the radially outermost portion of each rib 31 is about 9". FIG. 6 shows an alternative embodiment, wherein the rib section 31 is a single rib that spirals along the entire length of the body 20.

The generally cylindrical body 20 also includes a top end 33 and a bottom end 34. At the bottom end 34 is a base 35. Preferably, the base 35 may be securely attached to the bottom end 34. Alternatively, it may be attached in such a manner so that it may be easily removed. For example, the base 35 may have inner grooves (not shown) to allow the base to be friction fit to or screwed onto the body 20.

Figure 4:
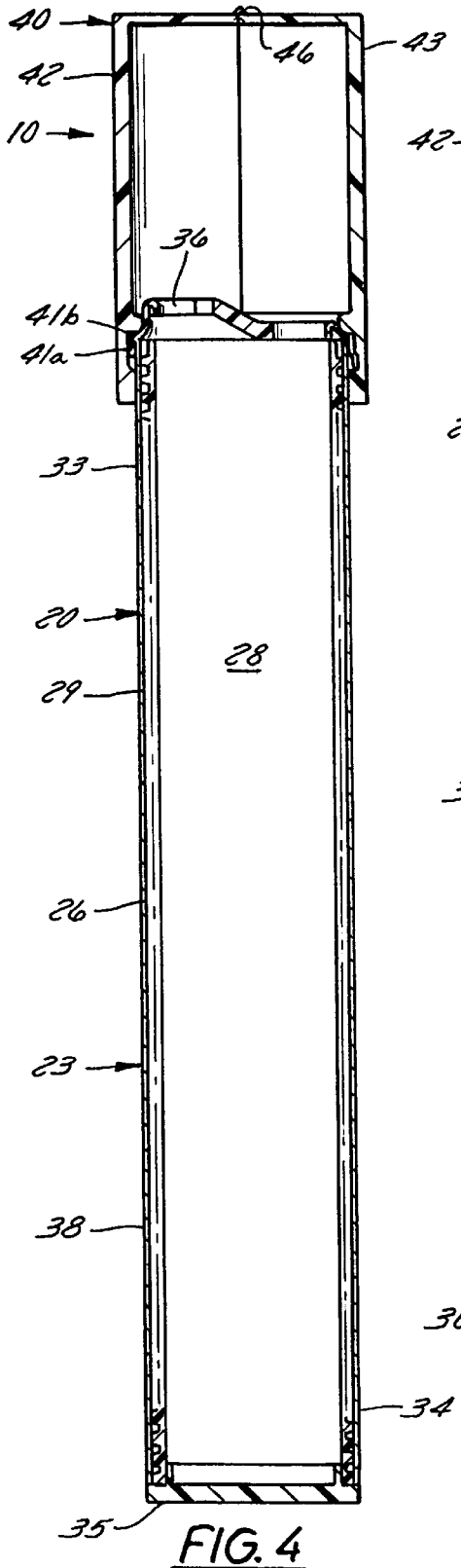
FIG. 4 is an elongated cross-sectional view of the sports equipment carrier of FIG. 2 taken along lines 4—4.
Figure 5:
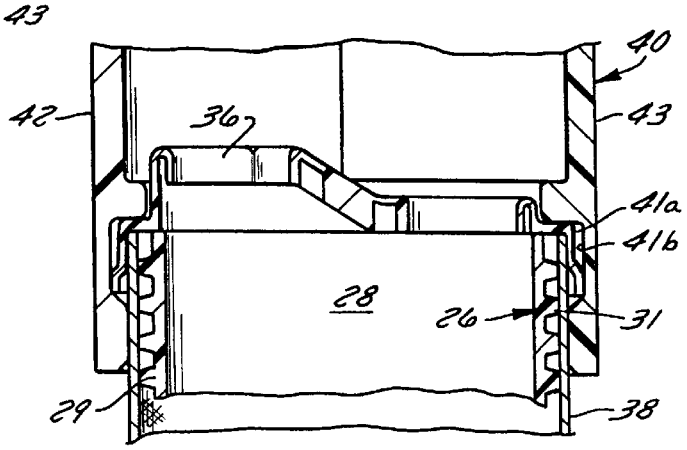
FIG. 5 is an enlarged cross-sectional elevational view of an upper portion of the sports equipment carrier of FIG. 1.
Figure 9:
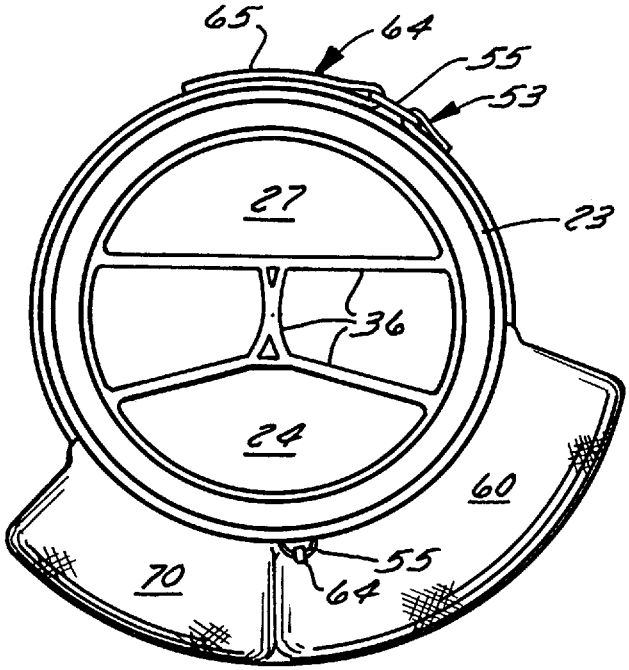
FIG. 9 is a top plan view of the sports equipment carrier as shown in FIG. 2 with the golf equipment removed.

Referring to FIGS. 4 and 9, in addition to the cavity 27, the inner section 24 of the body 20 can include an inner dividing wall 36 for further compartmentalization of the cavity. The inner wall 36 can also be made of a lightweight, high strength material such as HDPE. The inner wall 36 may consist of several branching portions to further prevent the sports equipment within the cavity 27 from becoming jostled and damaged during transit or shipment as shown in FIG. 9 by separating them.

Figure 2:
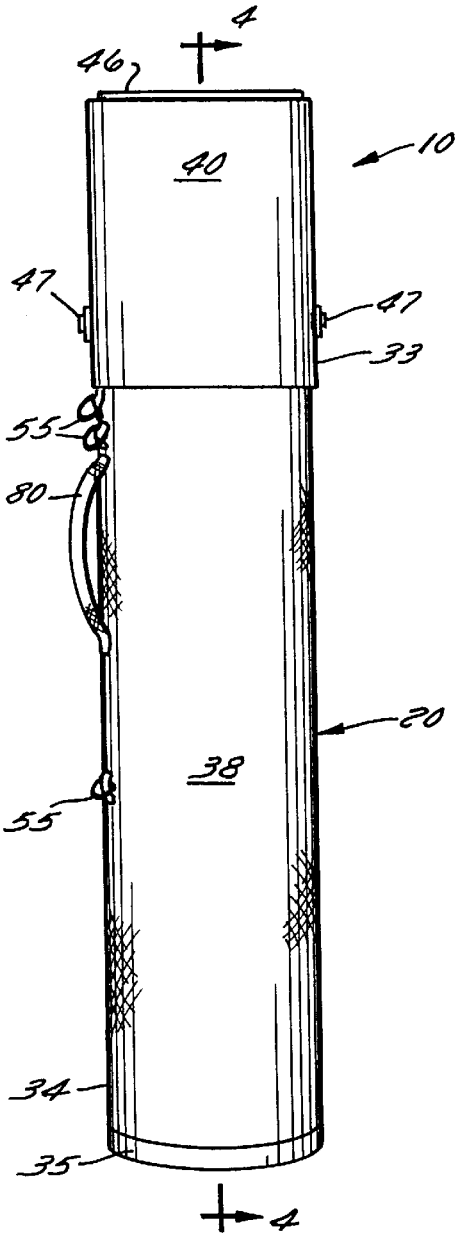
FIG. 2 is a perspective view of the sports equipment carrier of FIG. 1 prepared for transit.

FIGS. 1 and 2 show that an outer covering 38 may be attached to the generally cylindrical body 20 to cover the exterior of the rib section 31 and to prevent the outer portion 29 of the wall 26 from becoming scratched or marred. The outer covering 38 may be made of a durable, lightweight fabric such as nylon and may be selected from a multitude of colors to give the outer section 23 of the sports equipment carrier 10 a pleasing aesthetic appearance. The covering 38 may be sewn, snapped or buttoned to the body 20 or attached with other types of fasteners, such as hook and loop fasteners.

At the top end 33 of the generally cylindrical, tubular body 20 is a lid 40. The lid 40 is removably attached to one end to the body 20 by a lid fastener 41. For example, the lid fastener 41 may include a hole with a removable pin or a lip 41*a* and groove 41*b* which is incorporated in the rib section 31. The lid 40 may be made of any rigid material and includes two pieces, namely, a first element 42 and a second element 43 that are symmetric. When connected together, the elements 42, 43 enclose and sufficiently cover the top end 33 of the generally cylindrical body 20. Lid connectors 46 connect the first element 42 and the second element 43 together during transit and allow the elements to be removed from the body 20 for easy storage when not in use. The lid connectors 46 may be buckles, snaps, hinges, or holes and pins or combinations thereof. Latches 47 and locks 48 are also attached to the lid 40. The lock 48 may be a simple mechanical lock which when slid through a bore (not shown) in the latch 47 allows the lid 40 to be secured to the generally cylindrical body 20, thus protecting and preventing tampering with the sports equipment within the sports equipment carrier 10.

FIG. 1 shows a carrying strap 52 that is removably attached to the outer section 23 of the generally cylindrical body 20 by carrying strap clips 53. The carrying strap clips 53 may include (1) two piece clips, the first piece being an insertion piece having three prongs, the second piece being a receiving piece having three channels which allow for interlocking with the three prongs of the insertion piece, (2) straps, velcro, and D-rings, or (3) spring clips 54 and D-rings 55, or combinations thereof as shown in FIG. 1. Thus, the term "clip" is used throughout more expansively to encompass any imaginable generic fastener. The carrying strap 52 may also have a pad 56 to provide comfort to the sports equipment carrier's owner when grasping the strap or wearing the carrying strap over the shoulder.

A large pouch 60 with a flexible wall 62 and an inner cavity 63 may be removably attached with clips 64 (which may resemble and interconnect with D-ring 55) to the outer section 23 of the generally cylindrical body 20. The clips 64 also include straps 65 and D-rings 66. The flexible wall 62 may be constructed of nylon fabric and has a top section 67 and a bottom section 68 that are joined together by a fastener 69. Additional fasteners, such as 69*a*, may also be added for more storage space. The fasteners 69, 69*a* may be conventional zippers, buttons, buckles, snaps, hook and loop fasteners, or any other suitable fasteners. The cavity 63 of the large pouch 60 may be used for carrying additional sports equipment accessories and miscellaneous items.

A small pouch 70 having a flexible wall 71, a cavity 72, a top section 73, a bottom section 74, and a fastener 77 may be attached to the large pouch 60 to add additional storage capability to the sports equipment carrier 10. The small pouch 70 may also be removably attached to the generally cylindrical body 20 of the sports equipment carrier 10 by clips 78 which may resemble and interconnect with the clips 64 and the carrying strap clips 53. In the preferred embodiment, the clips 78 are straps which interconnect with the D-ring pieces 66 on the large pouch 60. The bottom section 74 of small pouch 70 may be attached to the bottom section 68 of large pouch 60 in any of several ways including sewing, snap fastening, zipping, buckling, and buttoning.

Handle 80 may be formed into the generally cylindrical body 20, or fastened to the outer section 23. The handle 80 allows the sports equipment carrier owner to carry the sports equipment carrier 10 when the carrying strap 52 has been removed. The handle 80 may be made of a lightweight, high strength material such as HDPE or a flexible nylon material.

A sports equipment carrier constructed in accordance with the invention can, if desired, have additional features depending on the type of sports equipment it is used to carry. For example, when used on a golf course the sports equipment carrier 10 becomes a golf equipment carrier or golf bag. In the following description of a second embodiment having additional features, like-elements are denoted by the same reference numerals, incremented by 100.

Figure 11:
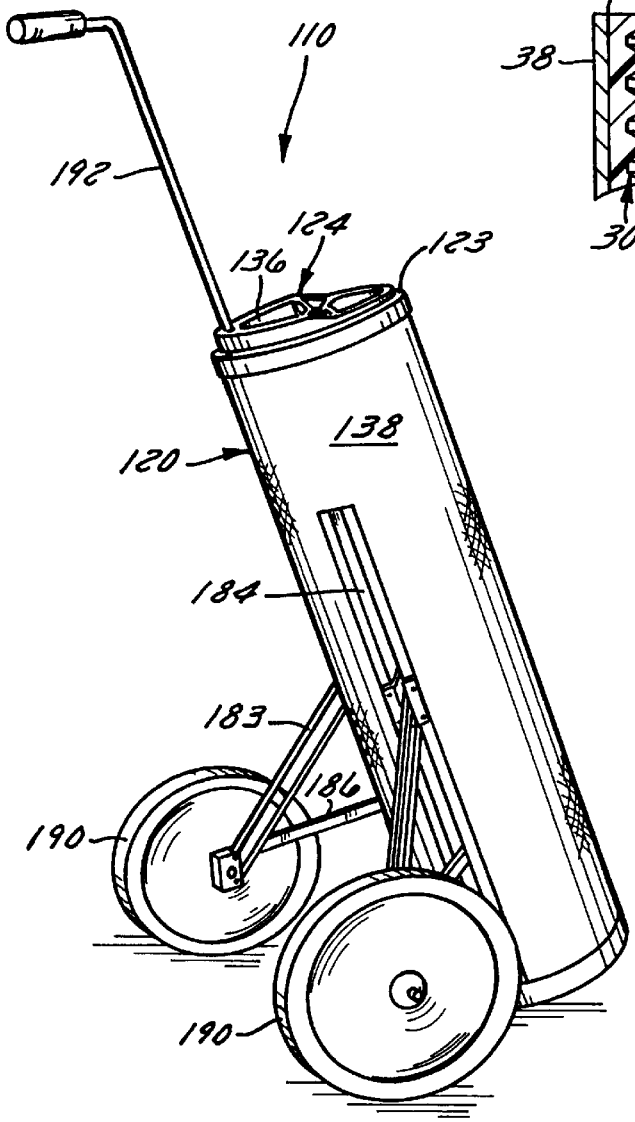
FIG. 11 is a perspective view of the sports equipment carrier constructed in accordance with another embodiment of the invention.
Figure 12:
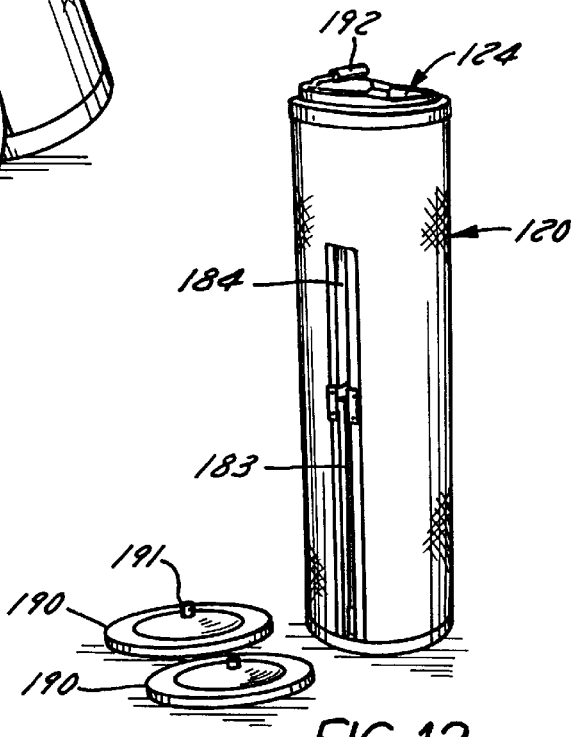
FIG. 12 is a perspective view of the sports equipment carrier of FIG. 11 with the wheels and axles removed and the legs collapsed.
Figure 13:
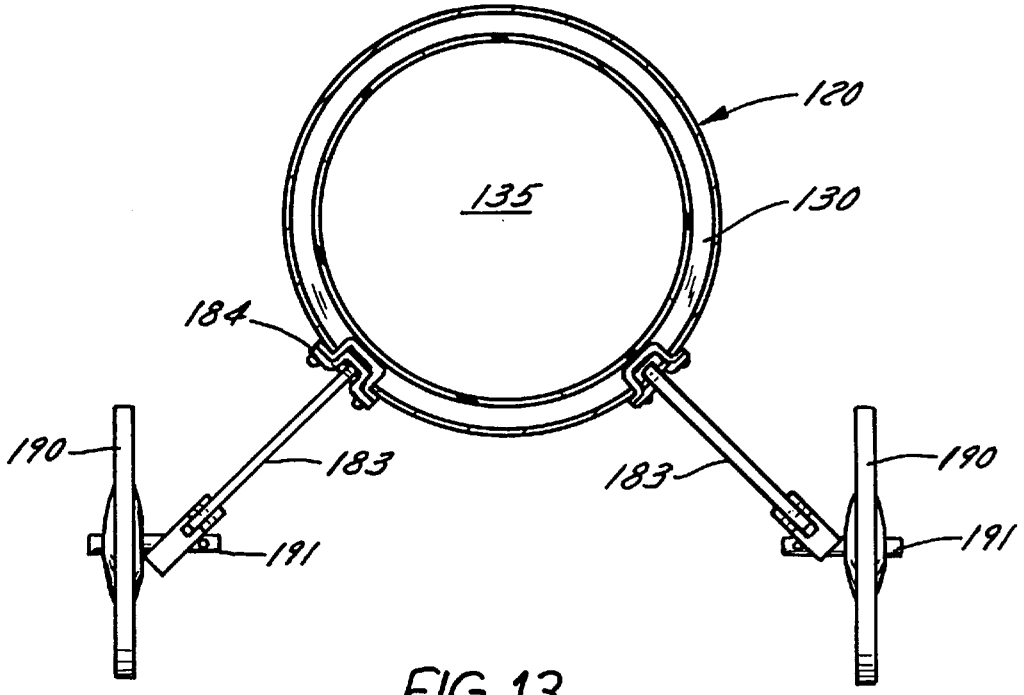
FIG. 13 is a slightly enlarged bottom plan view of the sports equipment carrier of FIG. 11.

Referring to FIGS. 11–14, golf bag 110, forming a sports equipment carrier constructed in accordance with a second embodiment of the invention having a club divider 136, a base 135 on the bottom, has legs 183 that hold the golf bag 110 in a nearly upright position. The legs 183 may be collapsibly connected in recessed channels 184 that are each about 20' long and about 1' deep. The channels 184 are both located in the generally cylindrical body 120 at a four o'clock position and an eight o'clock position (as shown in FIG. 13). The legs 183 may include collapsible brackets 186 that allow the legs to be collapsed into or removed from the recessed channels 184 to allow for ease of handling in transit (as shown in FIG. 12).

Additionally, wheels 190 may be rotatably engaged to axles 191. The axles 191 may be removably attached to the body 120 (not shown) or to the legs 183 (as shown in FIG. 12) to provide greater mobility for the golf bag 110. FIGS. 11 and 12 show a handle 192 that may be collapsibly connected to the outer section 123 or inner section 124 of the generally cylindrical body 120 to allow the golf bag owner to pull the wheeled golf bag 110 along the ground.

Figure 14:
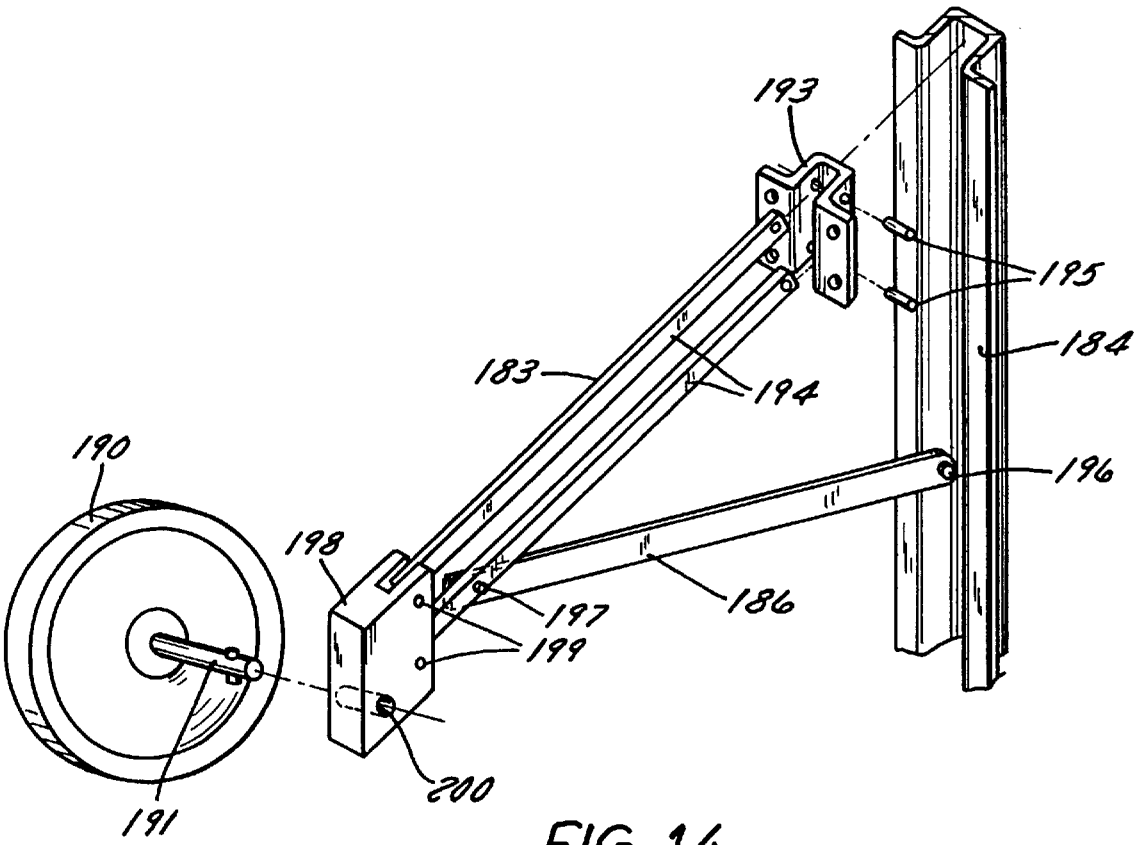
FIG. 14 is an exploded detail of the legs, recessed channels, wheels, brackets, and axles of the sports equipment carrier of FIG. 11.

As is shown in FIG. 14, the legs 183 are each attached to the golf bag 10 by a mounting bracket 193 received in recessed channel 184. Each leg 183 further includes a pair of elongate braces 194, each which is attached adjacent one end to bracket 193 by a pin 195. Bracket 186 has one end attached by a pin or rivet 196 to a recessed channel 184 and its other end by a pin 197 to one of the leg braces 194. A wheel mounting plate 198 is attached by pins 199 to the ends of the braces 194 adjacent collapsible bracket pin 197 and has a bore 200 with the axle 191 of wheel 190 received therein. FIG. 12 shows the golf bag 110 with its wheels 190 removed and legs 183 received in channels 184. FIGS. 11–13 show the wheels 190 attached to its legs 183 such that the golf bag 110 is a cart that can be rolled along the ground.

USE AND OPERATION

For example, the sports equipment carrier 10, while in use on a golf course as a golf bag, may be easily disassembled and packed up for immediate transition from playing to traveling in the following manner. Below is generally a description of the transition steps of the first embodiment. Where the transition steps differ between the second and the first embodiment, additional steps are described. However, all the steps disclosed relating to the first embodiment are also accomplished with the second embodiment.

Figure 3:
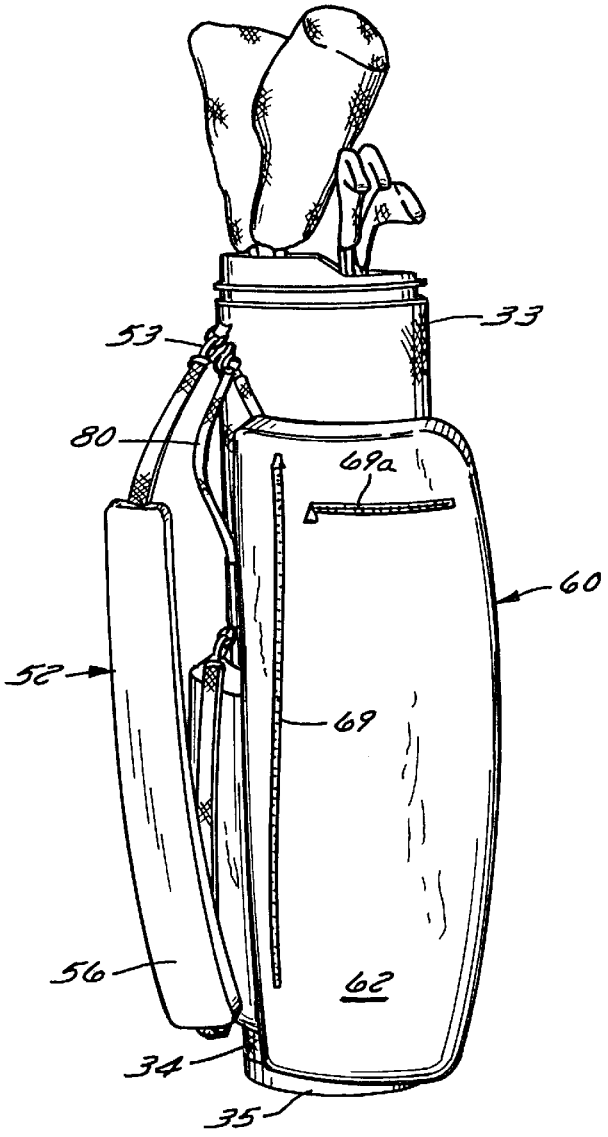
FIG. 3 is a perspective view of the sports equipment carrier of FIG. 1 adapted for use in carrying golf clubs.

FIG. 3 shows the golf bag 10 of the first embodiment as it would appear during play on a golf course. In order to begin transition, first, the lid 40 is removed from the cavity 63 of the large pouch 60. If not already connected together, first element 42 of the lid 40 would be connected by the lid connectors 46 (shown as hinges and a removable pin) to the second element 43. The lid 40 would then be attached to the top end 33 of the body 20 by the lid fastener 41 (shown as lip 41*a* and groove 41*b* ). The lid 40 would be secured to the top end 33 of the body 20 by latches 47 and the locks 48 to prevent anyone from tampering with the golf equipment in the golf equipment carrier 10 during travel.

If the golf bag 110 of the second embodiment was undergoing transition from play to transit, first, the retractable handle 192 would be collapsed into the inner section 124 of the generally cylindrical body 120. Next, the legs 183 and the removably attached axles 191 and wheels 190 would be collapsed into or removed from the recessed channels 184 in the body 120 (as shown in FIG. 12). In the preferred embodiment, the collapsible brackets 186 would collapse into the legs 183 and the legs would be collapsed into the channels 184 after the wheels 190 and axles 191 have been removed from each leg. Alternatively, the legs 183, the collapsible brackets 186, the wheels 190, and the axles 191 would be removed and inserted into in internal cavity 63 of a large pouch 60 for storage (FIG. 1). Then a top section 67 of large pouch 60 would then be joined to a bottom section 68 by fastener 67 (not shown). After the legs and/or wheels are secured, a lid 40 is attached as described above.

Returning to the first embodiment shown best in FIGS. 1–3, the clips 64, the straps 65, and the D-rings 66 attaching the large pouch 60 to the body 20 would be removed from the D-ring pieces 55 on the body. Additional sports equipment such as golf balls, tees, gloves, hats, shoes or other miscellaneous items would be placed in the cavity 72 of the small pouch 70. The top section 73 of the small pouch 70 would be joined to the bottom section 74 by the fastener 77. Then straps 78 would be removed from the D-rings 66 for the large pouch 60 and the small pouch 70 would be removed from the body 20. The spring clip pieces 54 of carrying strap clips 53 would be removed from the D-ring pieces 55 on the body 20 to remove the carrying strap 52. Next, the spring clip pieces 54 of the carrying strap 52 would be fastened to a D-ring 66 on the large pouch 60 and the clip 64 on the large pouch 60. The straps 65, 78 would then be looped back through the D-rings 66 and secured, and thus the top 73 of small pouch 70 would attach to the top 67 of the large pouch 60 to allow for easy carrying of both the large pouch 60 and small pouch 70 by the carrying strap 52.

After the large pouch 60, the small pouch 70, and the carrying strap 52 have been removed from the body 20 and attached together, the sports equipment carrier 10 is less bulky and more lightweight for greater carrying ease during travel (best shown in FIG. 2). The removably attached pouches 60 and 70 can be separated from the rest of the equipment in the sports equipment carrier 10 to further decrease the likelihood of having all of the sports equipment lost or stolen during transit or shipment. Furthermore, the removal of the pouches 60 and 70 leaves a less bulky, more streamlined carrier that offers less resistance to the handler and thus prevents exterior damage to the pouches and the outer section 23 of the carrier 10.

During transit, a carrier 10 with the lightweight, high strength to weight ratio structure 30 of this invention will be better able to withstand any impact shock or a high degree of crushing force if the equipment carrier 10 is mishandled by baggage handlers. For example, the ribs of the rib section 31 or the honeycombs 32 allow the equipment carrier 10 to absorb significant impact without damaging the equipment within.

Although the sports equipment carrier 10 described above is particularly well suited as a golf equipment carrier, the equipment carrier may be used to carry any sports equipment that is somewhat fragile and difficult to replace. For example, the sports equipment carrier may be used to carry snow skis and poles, water skis, competition arms, fishing equipment, rackets, croquet clubs, billiard cues, and hockey sticks.

Many other changes could be made to the invention as described above without departing from the spirit thereof. The scope of these changes will become apparent from the appended claims.

We claim:

1. A golf bag and shipping container comprising:

a. an elongate and tubular hollow body comprised of a continuous tubular sidewall defining a storage cavity within said body that opens at one end of said body with said storage cavity constructed and arranged to receive a plurality of golf clubs therein with said golf bag body having a plurality of compartments in said storage cavity each for receiving one of said golf clubs, b. a generally rigid removable lid for covering said storage cavity opening when attached to said body, said lid constructed and arranged to retain said golf clubs received in said storage cavity, c. wherein said sidewall is comprised of a plurality of axially spaced apart, substantially rigid generally transversely extending annular and circumferentially continuous ribs that are integral with said sidewall and which are distributed substantially along the entire longitudinal length of said body for increasing strength and crush resistance of said body, and d. wherein said sidewall comprises at least a plurality of pairs of said ribs.

2. The golf bag and shipping container of claim 1 wherein each said rib extends radially outwardly from said sidewall.

3. The golf bag and s hipping container of claim 2 further comprising a pair of legs attached to said sidewall and a wheel attached to each said leg.

4. The golf bag and shipping container of claim 3 further comprising a fabric covering the exterior of said body, and a flexible fabric pouch removably attached to said body by a clip.

5. A golf bag comprising an elongate, tubular and generally cylindrical substantially rigid body having axially spaced apart and annular ribs that are each integral with said body, radially outwardly extending, circumferentially continuous, and transverse to the lengthwise direction of said body, and which are distributed axially along the length of said body for strengthening and imparting crush-resistance to said body with said body having an opening at one end for receiving a plurality of golf clubs within said body, and a removable rigid lid for covering said opening to retain said golf clubs and for converting said golf bag into a protective shipping container.

6. The golf bag of claim 5 wherein said body comprises a tubular and generally cylindrical inner sidewall with said ribs begin integral with said sidewall and extending radially outwardly from said sidewall.

7. The golf bag of claim 6 further comprising a tubular fabric covering substantially the entire exterior of said ribs and said sidewall for providing an aesthetic golf bag exterior.

8. The golf bag of claim 7 wherein said body has a plurality of pairs of said ribs.

9. The golf bag of claim 8 wherein said ribs are spaced apart about one-quarter inch from each other.

10. The golf bag of claim 8 wherein each said rib is about seven-tenths of an inch wide and has a height of about one-half inch.

11. The golf bag of claim 8 wherein said sidewall has a cross sectional thickness of about one-tenth of an inch.

12. The golf bag of claim 8 wherein said sidewall has a cross sectional thickness of about one-tenth of an inch, each said rib is about seven-tenths of an inch wide and has a height of about one-half inch, and said ribs are spaced apart from each other about one-quarter inch.

13. The golf bag of claim 12 wherein said sidewall and said ribs are comprised of plastic.

14. The golf bag of claim 13 wherein said sidewall and said ribs are comprised of high density polyethylene.

15. The golf bag of claim 8 further comprising a branching portion dividing said opening into a plurality of compartments with each said compartment for receiving one of said golf clubs.

16. The golf bag of claim 8 further comprising a base attached to said body opposite said opening.

17. A golf bag comprising a) an elongate and generally cylindrical inner substantially rigid sidewall having a plurality of pairs of axially spaced apart annular and substantially rigid circumferentially continuous and integral ribs that are each generally transverse to a lengthwise direction of said body and which extend radially outward from said sidewall such that said ribs are axially distributed along the length of said sidewall for imparting crush resistance to said golf bag and wherein said sidewall and said ribs form a tubular and elongate golf bag body of unitary and generally cylindrical construction having an opening at one end defining a storage cavity for receiving a plurality of golf clubs therein and a closed base at its opposite end, and b) a generally rigid lid removably attached to said golf bag body adjacent said opening for covering said opening and retaining said golf clubs in said golf bag to convert said golf bag to a protective shipping container when attached while enabling said golf bag to be used as a golf bag when detached.

18. A golf bag comprising:

a. an elongate, generally cylindrical and tubular body comprised of a plastic having an opening at one end for receiving a plurality of golf clubs with said body comprised of a generally cylindrical sidewall having axially spaced apart annular, transverse, and circumferentially continuous ribs radially extending from said wall and distributed along the length of said sidewall wherein said sidewall has a thickness of about one-tenth of an inch, each said rib has a width of about seven-tenths of an inch and a height of about one-half inch, and adjacent said ribs are spaced apart about one-quarter producing a golf bag of light weight, crush resistant construction;

b. a dividing wall dividing said opening into a plurality of compartments each said compartment for receiving one of said golf clubs;

c. a base attached to said body adjacent an end of said body opposite said opening for closing said body at one end; and d. a removable lid for attachment to said body to cover said opening to retain and protect said golf clubs wherein said lid can be attached to said body to convert said golf bag into a protective shipping container and said lid can be removed so that said golf bag can be used as a golf bag.

19. A golf bag comprising a body made of a single substantially rigid tubular honeycombed sidewall having an opening at one end defining a storage cavity within for receiving therein a plurality of golf clubs and being closed at its opposite end, a removable and substantially rigid lid attached to said body for enclosing said opening to retain said golf clubs in said golf bag for enabling said golf bag to be used as a shipping container when said lid is attached to said golf bag body, and wherein said honeycombed sidewall comprises radially extending honeycombs distributed axially along the entire length of said honeycombed sidewall.

20. The golf bag of claim 19 wherein said honeycombed sidewall is comprised of high density polyethylene.

21. A sports equipment carrier comprising an elongate and generally cylindrical hollow body having a wall defining a storage cavity within said body that opens at one end of said body and which is closed at its other end, said cavity constructed and arranged to receive at least one sports equipment article therein, and said wall being honeycombed comprising a plurality of honeycomb cells with each said honeycomb cell oriented generally perpendicular relative to the lengthwise direction of said body;

1) a lid of clamshell construction having a pair of lid elements connected by a hinge with said lid elements movable between a) a closed position where said lid elements abut for enclosing said storage cavity opening and engaging said body, and b) a position disposed from said closed position for permitting disengagement of said lid from said body;

2) a lip on one of said body and said lid and a groove on the other of said body and said lid for coupling said lid to said body when said lid is in said closed position; and 3) a retainer in operable cooperation with one of said lid elements for retaining said lid elements in said closed position.

22. The sports equipment carrier of claim 21 wherein said wall comprises an inner wall portion that is of continuous construction which defines said cavity and said cells of said honeycombed wall extend radially outwardly from said inner wall portion.

23. The sports equipment carrier of claim 22 wherein said inner wall portion and said honeycomb cells are of integral construction.

24. The sports equipment carrier of claim 21 further comprising a generally tubular fabric sleeve covering said body, a carrying strap removably attached to said body by a plurality of clips, a pouch removably attached to said body.

* * * * *